United States Patent [19]

Perez

[11] Patent Number: 5,075,830

[45] Date of Patent: Dec. 24, 1991

[54] ILLUMINATED BALLOON

[76] Inventor: Rafael Perez, 850 N. Miami Ave., Apt. 1809, Miami, Fla. 33131

[21] Appl. No.: 674,794

[22] Filed: Mar. 18, 1991

[51] Int. Cl.[5] ..... F21V 1/06

[52] U.S. Cl. ..... 362/352; 362/190; 362/253; 362/806

[58] Field of Search ..... 362/101, 189, 190, 191, 362/253, 352, 806, 811, 96; 446/219, 220, 222, 484, 485, 901; 40/559, 560, 214, 594

[56] References Cited

U.S. PATENT DOCUMENTS

| | | | |
|---|---|---|---|
| 2,557,383 | 6/1951 | Kerwer | 40/214 |
| 3,672,083 | 6/1972 | Moran | 446/220 |
| 4,542,445 | 9/1985 | Marletta | 362/96 |
| 4,794,498 | 12/1988 | Neumeier | 362/186 |

FOREIGN PATENT DOCUMENTS

| | | | |
|---|---|---|---|
| 2004368 | 8/1971 | Fed. Rep. of Germany | 446/220 |
| 717535 | 3/1932 | France | 362/806 |
| 2460517 | 2/1981 | France | 446/220 |

*Primary Examiner*—Ira S. Lazarus
*Assistant Examiner*—Sue Hagarman
*Attorney, Agent, or Firm*—Malloy, Downey & Malloy

[57] ABSTRACT

An illuminated balloon having a front face and a rear face sealed together about an outer peripheral edge in surrounding relation to an interior gas chamber, and a neck portion integrally formed therewith to facilitate filling of gas within the interior chamber. An electric lamp is fixedly attached to an outer surface of the balloon so as to direct light through the interior chamber effectively illuminating a design on at least one of the faces of the balloon. A battery pack is electrically interconnected to the electric lamp by a pair of substantially thin gauge wires intertwined to form a cord extending therebetween.

14 Claims, 2 Drawing Sheets

ILLUMINATED BALLOON

BACKGROUND OF THE INVENTION

1. Field of the Invention

The present invention relates generally to illuminated balloons, and more specifically, to an illuminated balloon having a translucent design on at least a portion of the balloon wherein light directed into the interior of the balloon from an externally attached electric lamp effectively illuminates the design.

2. Description of the Related Art

Balloons have always been a source of visual pleasure and entertainment especially for children. Often, balloons are filled with helium and may include a design or advertisement printed on an outer surface making the balloon an effective means for display. Most recently, Mylar® balloons have become quite popular being formed of a non-latex material and usually having a chrome finish with a design or a message on the outer surface. Many of these Mylar® balloons have popular animated characters printed on their outer surface and some are even formed into the shape of various characters or animals having extremities such as arms and legs attached thereto.

While most balloons, including the Mylar®-type balloons, are considerably attractive in daylight or in a bright, well-lit atmosphere, their attractiveness cannot be appreciated at night or in dark places such as the circus, evening sporting events, or simply outdoors during the evening hours. These are the circumstances during which balloons are often sold and enjoyed by the consumer and surrounding public.

There have been attempts in the past to illuminate balloons by inserting a light bulb into the interior of the balloon so as to achieve a glowing or illuminated effect. One such attempt is illustrated in the U.S. Patent to Marletta, U.S. Pat. No. 4,452,445, wherein an elongated housing having a light bulb attached to an upper end is inserted through the neck of a balloon so as to position the light bulb within an interior portion of the balloon. The elongated housing extends downwardly out through the neck of the balloon and includes a switch attached at the bottom end.

Another related device is disclosed in the patent Neumeier, U.S. Pat. No. 4,794,498, directed to an accessory device for an inflatable gas balloon wherein a cup-shaped housing having a rim portion and light bulb attached thereto is fitted within the balloon neck so as to position the light bulb in a lower portion of the balloon interior.

While the above patents may be useful for their intended purpose, they are considerably complex requiring means to allow gas to escape from the balloon as heat is generated by the light bulb within the balloon interior.

Accordingly, there still exists a need in the present balloon art for an illuminated balloon apparatus adapted to direct light through the interior of a balloon so as to at least partially illuminate a design printed on the balloon.

It is, therefore, an object of the present invention to provide an illuminated balloon assembly, wherein a low voltage light bulb is affixed to an outer surface of the balloon so as to effectively direct light through an interior portion thereof in such a manner so as to at least partially illuminate the balloon and a design printed thereon.

It is another object of the present invention to provide an illuminated balloon having a translucent design printed on at least a portion of the surface thereof wherein light directed from an electric lamp attached to an outer surface of the balloon effectively directs light through the balloon interior thereby illuminating the translucent design.

It is still a further object of the present invention to provide a Mylar® balloon having a 3.5 volt flashing electric lamp attached to an outer surface thereof, wherein light emitted from the bulb effectively illuminates a translucent design printed on the balloon.

It is still a further object of the present invention to provide an illuminated balloon assembly which is relatively simple and inexpensive to manufacture making it marketable to a large percentage of the population.

These and other objects and advantages of the present invention will be more readily apparent from the description which follows.

SUMMARY OF THE INVENTION

The present invention is directed to an illuminated balloon having a front face and a rear face and a light assembly including an electric lamp attached to an outer surface of the balloon so that light emitted from the electric lamp effectively illuminates a design printed on at least one of the faces of the balloon.

In a preferred embodiment of the invention, the balloon is made of a non-latex material such as avoh and includes a front face and a rear face sealed together about a peripheral edge so as to enclose an interior gas chamber. The interior gas chamber can be filled with any conventionally known gas ordinarily used to fill balloons including helium or air.

The front face of the balloon can be either transparent or opaque with a substantially translucent design printed thereon. The rear face is preferably either transparent or may have a chrome finish on both its inner and outer surface.

The light assembly of the present invention comprises a small 3.5 volt flashing bulb electrically interconnected to a battery pack by a thin gauge electrical conductor. In the preferred embodiment, the conductor consists of a pair of positive and negative thin gauge wires intertwined with one another so as to define a cord extending between and electrically connected to the battery pack and a socket which houses the flashing bulb. The flashing bulb is attached to the outer surface of either the front face or the rear face of the balloon using opaque tape. The opaque tape is adhered to the outer surface of the balloon in covering relation to the flashing bulb so as to maintain the bulb in a fixed, mounted position against the outer surface of the balloon. Preferably, the tape includes a highly reflective inner surface which is adapted to reflect light emitted from the bulb into the balloon interior.

In one embodiment of the present invention, the front face is opaque and includes a substantially translucent design printed thereon. The rear face can be either clear or have a chrome finish. The flashing bulb is attached to a transparent on the rear face thereon so that light emitted from the bulb is directed through the interior of the balloon and onto an inner surface of the front face with at least a portion of the light passing through the translucent design so as to effectively illuminate the design.

In another embodiment of the present invention, the flashing bulb is attached to the front face, which may be either transparent or opaque, whereupon light emitted from the bulb is directed through the balloon interior and onto an inner reflective surface of the rear face. Light reflected off of the inner surface of the rear face effectively illuminates at least the design on the front face of the balloon.

In use, with the balloon being filled with helium, the electrical conductor serves as an attaching cord between the battery pack and the balloon, wherein the battery pack serves as a handle means. It should be noted that any combination of clear, opaque and chrome faces may be used within the spirit and scope of the present invention, including a balloon having a clear front and rear face.

The invention accordingly comprises the features of construction, combination of elements, and arrangement of parts which will be exemplified in the description hereinafter set forth and/the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
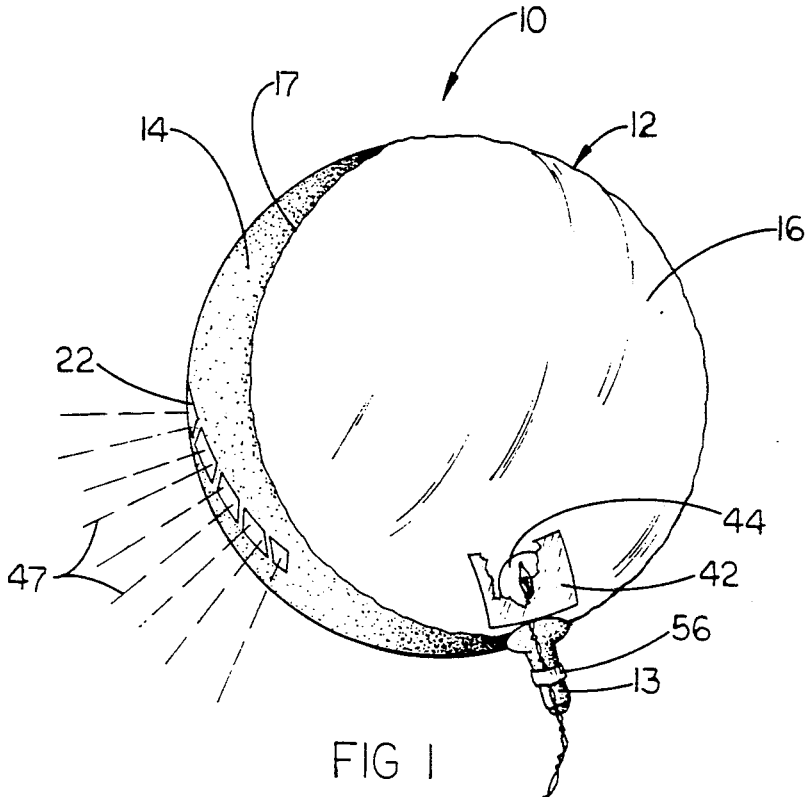
FIG. 1 is a perspective view of a preferred embodiment of the illuminated balloon of the present invention.
Figure 2:
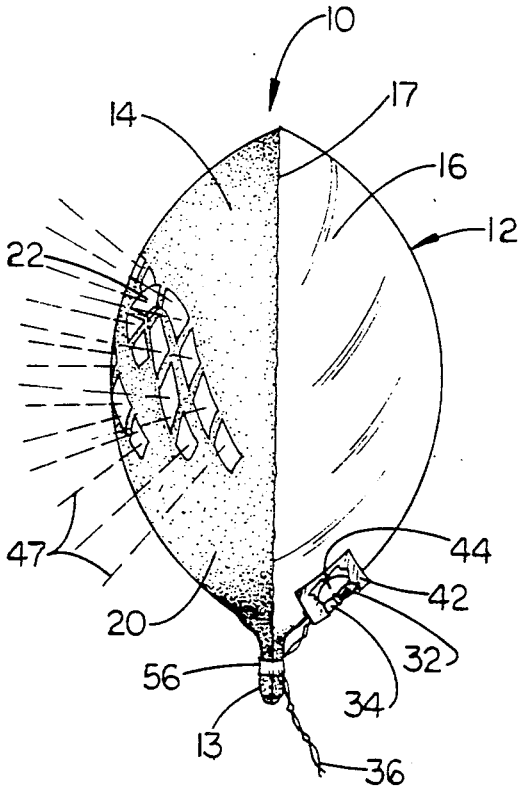
FIG. 2 is a side plan view of the embodiment of FIG. 1.

With reference to Figure the present invention is directed to an illuminated balloon apparatus generally indicated as 10, including a balloon 12 having a front face 14 and a rear face 16 sealed together about a seam 17 alon correspondingly positioned peripheral edges thereof. In a preferred embodiment, as illustrated in FIGS. 1 and 2, the front face 14 of the balloon 12 includes a substantially opaque portion 20 and a substantially translucent design printed thereon, wherein the translucent design is adapted to allow at least partial passage of light therethrough. The rear face 16 of the balloon 12 can be either transparent or opaque and may include a chrome finish both on its inner and outer surface.

Figure 3:
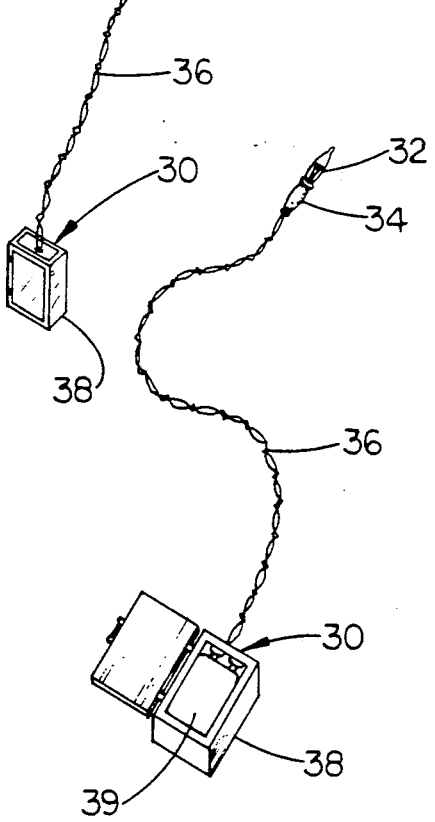
FIG. 3 is a perspective view of the light assembly of the present invention.
Figure 4:
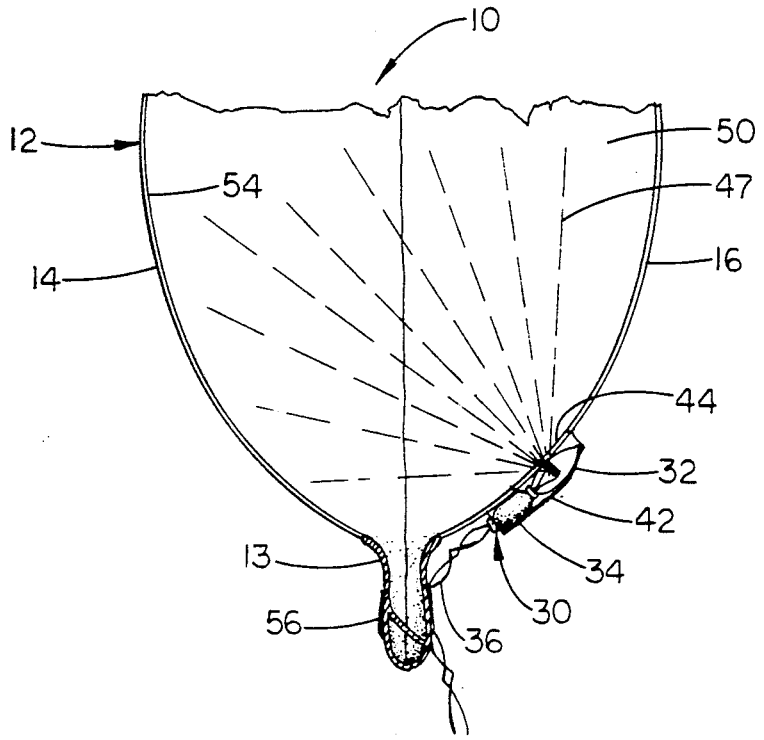
FIG. 4 is a cutaway view in partial section illustrating light being emitted from the light assembly into the balloon interior.
Figure 5:
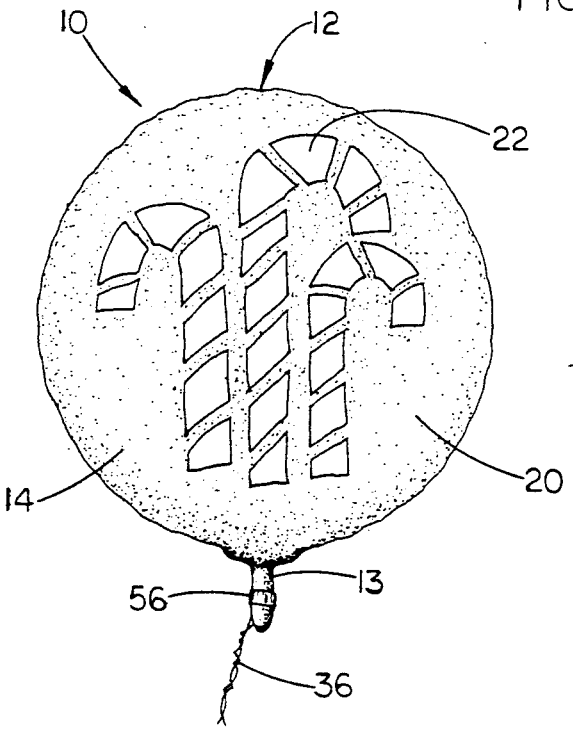
FIG. 5 is a front plan view of the embodiment of FIG. 1.

Referring to FIGS. 1–3, an important feature of the present invention is a light assembly generally indicated as 30 including a 3.5 volt flashing light bulb 32 housed within and electrically interconnected to a receiving socket 34. An electrical conductor 36, comprising a pair of relatively thin gauge wires intertwined with one another, extends between and is integrally connected to the socket 34 and a battery pack 38 which houses a conventional battery 39 adapted to supply power to the light bulb 32. As seen in FIG. 1, the light bulb 32 and socket 34 are attached to an outer surface of the balloon 12 by means of an opaque tape 42. In the instance the face to which the light bulb is to be attached is either opaque or of a chrome finish, a clear, transparent area 44 is provided with the light bulb 32 being positioned in adjacent relation thereto so that light 47 emitted from the bulb is effectively dispersed into an interior gas chamber 50 of the balloon, as illustrated in FIG. 4. At least a portion of that light 47 is directed onto an inner surface 54 of the front face 14 and out through the translucent design 22 as shown in FIGS. 1 and 2.

The electrical conductor 36 extending between the socket 34 and the battery pack 38 is preferably attached to a neck portion 13 of the balloon 12 by tape 56 or other like attachment means. Ordinarily, the interior gas chamber 50 of the balloon 12 is filled with helium so that the balloon 12 has a tendency to float upwardly. In this instance, the electrical conductor 36 serves as a connecting cord between the balloon 12 and the battery pack 38. The battery pack 38 provides an ideal handle means for the user to grasp as the balloon 12 floats upwardly in a preferred, display orientation.

Figure 6:
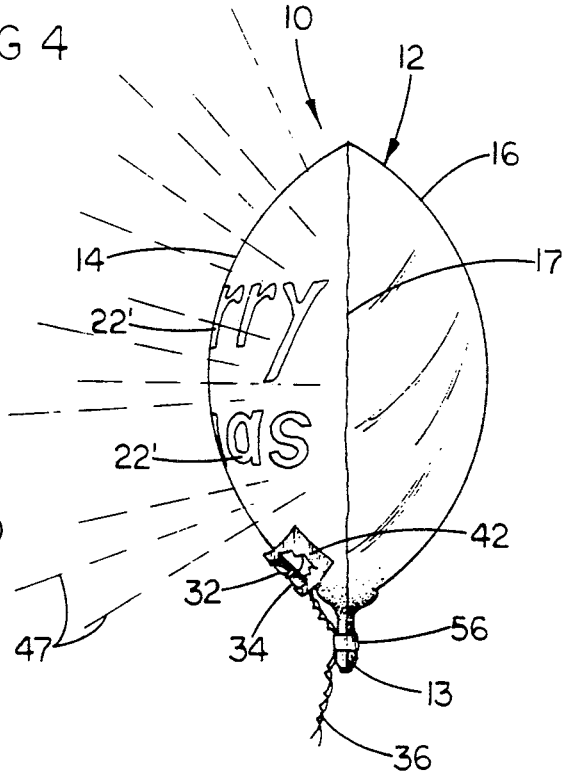
FIG. 6 is a side plan view of an alternative embodiment of the present invention.

An alternative embodiment of the present invention is illustrated in FIG. 6, whereupon the light bulb 32 and socket 34 is mounted to the front face 14 of the balloon which is transparent and includes the translucent design 22' thereon. In this particular embodiment, the rear face 16 preferably includes a chrome finish on both the inner and outer surface thereof, whereupon light directed from the light bulb 32 is directed through the interior gas chamber 50 reflecting off of the inner surface of the rear face 16 and out through the transparent front face 14 so as to illuminate the entire front face as well as the translucent design 22' thereon.

While the present invention has been disclosed in connection with the preferred embodiment thereof, it should be understood that there may be other embodiments which fall within the spirit and scope of the invention as defined by the following claims.

What is claimed is:

1. An illuminated display apparatus, comprising:

a balloon having an inflatable body and a neck integrally formed therewith, said inflatable body disposed in air tight, sealed relation about a hollow interior gas chamber, a translucent design printed on at least a portion of said inflatable body, an electric lamp fixedly attached to an outer surface of said inflatable body and structured and disposed to direct light into said interior gas chamber and at least partially out through said translucent design, thereby effectively illuminating said translucent design, said electric lamp being attached to said outer surface of said inflatable body with an opaque tape, said opaque tape including a highly reflective inner surface adapted to substantially reflect said light emitted from said electric lamp into said interior gas chamber, and a battery container structured to contain a battery therein and electrically interconnected to said electric lamp by substantially thin gauge conductor wires.

2. An apparatus as in claim 1 wherein said inflatable body is formed of a non-latex material.

3. An apparatus as in claim 2 wherein said inflatable body includes a front face and rear face sealed together substantially about an outer peripheral edge in surrounding, sealed relation to said hollow interior gas chamber.

4. An apparatus as in claim 3 wherein said electric lamp comprises a 3.5 volt flashing bulb electrically interconnected to and seated within a socket.

5. An apparatus as in claim 4 wherein said front face and said rear face are formed of a transparent material.

6. An apparatus as in claim 4 wherein said translucent design is disposed on both said front face and said rear face.

7. An apparatus as in claim 4 wherein said translucent design is disposed on said front face.

8. An apparatus as in claim 7 wherein said rear face is formed of a substantially transparent non-latex material.

9. An apparatus as in claim 7 wherein said electric lamp is attached to said outer surface of said rear face so as to effectively direct said light through said interior gas chamber and substantially through said translucent design on said front face.

10. An apparatus as in claim 7 wherein said battery pack defines a handle portion to facilitate holding of the display apparatus, said electrical conductor wires defining a connecting cord extending between said battery pack and said balloon.

11. An apparatus as in claim 7 wherein said rear face is formed of a substantially opaque non-latex material.

12. An apparatus as in claim 11 wherein said rear face includes a highly reflective chrome finish on an inner surface and an outer surface thereof.

13. An apparatus as in claim 12 wherein said electric lamp is attached to an outer surface of said front face so as to effectively direct said light through said interior gas chamber and onto said chrome finish on said inner surface of said rear face, wherein said light is reflected off of said inner surface of said rear face and dispersed throughout said interior gas chamber and at least partially out through said translucent design on said front face.

14. An apparatus as in claim 12 wherein said battery pack defines a handle portion to facilitate holding of the display apparatus, said electrical conductor wires defining a connecting cord extending between said battery pack and said balloon.

* * * * *